United States Patent [19]

Ramsey et al.

[11] 4,229,015

[45] Oct. 21, 1980

[54] SKI POLE ADAPTED TO CONTAIN A LIQUID

[76] Inventors: Richard R. Ramsey, 1121 Davis St., Clovis, N. Mex. 88101; James B. Ramsey, Rte. 5, Box 300, Los Lunas, N. Mex. 87031

[21] Appl. No.: 909,563

[22] Filed: May 25, 1978

[51] Int. Cl.[2] ..... A63C 11/22

[52] U.S. Cl. ..... 280/819; 135/66; 222/552

[58] Field of Search ..... 280/11.37 B, 11.37 D, 280/11.37 H, 11.37 L, 11.37 N, 11.37 E; 135/66; 220/375; 222/552

[56] References Cited

U.S. PATENT DOCUMENTS

| | | | |
|---|---|---|---|
| 1,902,003 | 3/1933 | Werder | 222/552 X |
| 2,473,158 | 6/1949 | Luekens, Jr. | 280/11.37 B |
| 2,741,485 | 4/1956 | Storm et al. | 280/11.37 B |
| 3,443,820 | 5/1969 | Baker | 280/11.37 D |
| 3,561,782 | 2/1971 | Tyrack | 280/11.37 D |
| 3,565,451 | 2/1971 | Giambazi | 280/11.37 H |
| 3,880,443 | 4/1975 | Tobin | 280/11.37 H |
| 3,982,747 | 9/1976 | Schweinsberg | 280/11.37 H |

FOREIGN PATENT DOCUMENTS

| | | | |
|---|---|---|---|
| 2628142 | 5/1977 | Fed. Rep. of Germany | 280/11.37 H |
| 245106 | 6/1947 | Switzerland | 280/11.37 H |
| 695403 | 8/1953 | United Kingdom | 220/375 |

*Primary Examiner*—John J. Love
*Assistant Examiner*—Milton L. Smith
*Attorney, Agent, or Firm*—James E. Bryan

[57] ABSTRACT

A ski pole comprises a shaft, a hand grip, a stop basket, cavity means in said shaft, adapted to contain a liquid, hand strap means on said hand grip, and access means, in said hand grip, to said cavity means.

1 Claim, 6 Drawing Figures

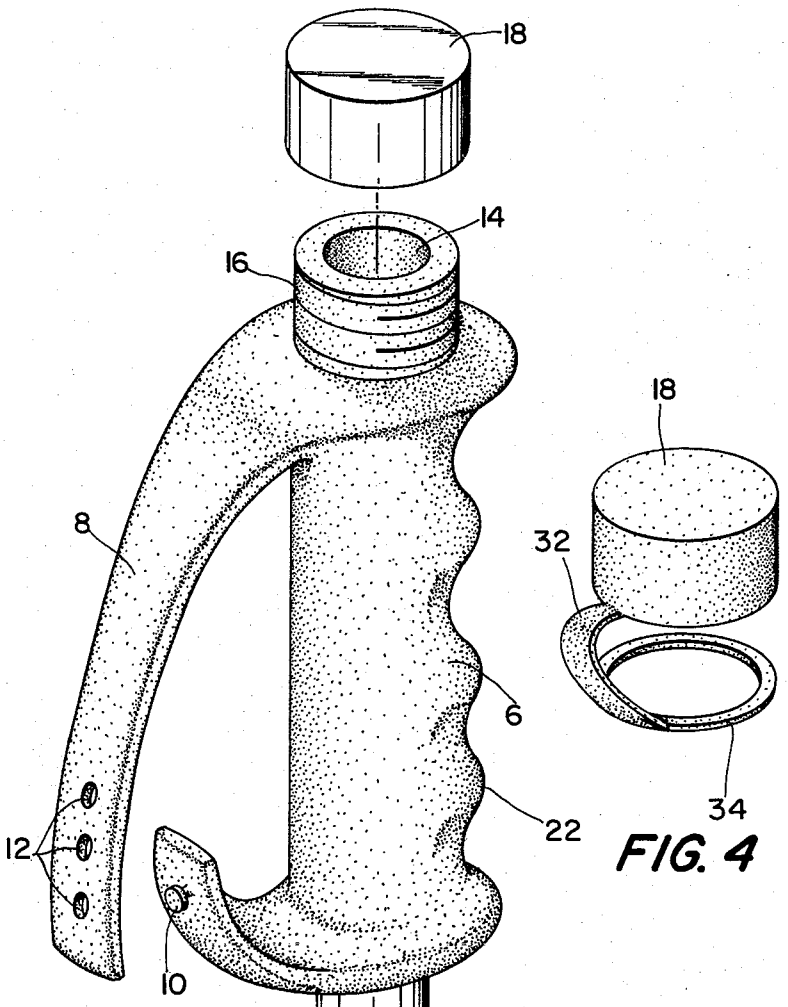
FIG. 3
FIG. 4
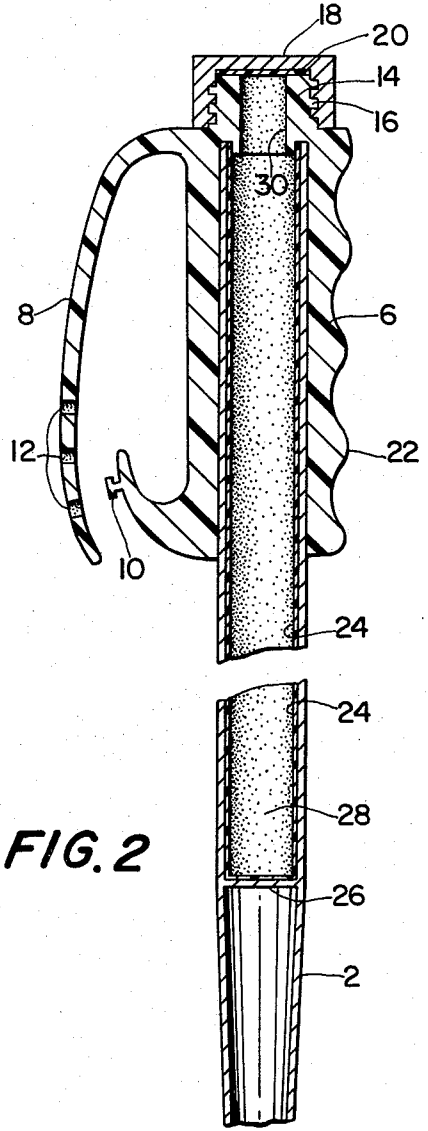
FIG. 2
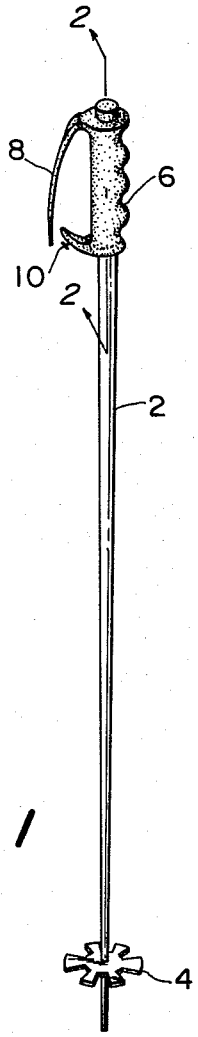
FIG. 1

SKI POLE ADAPTED TO CONTAIN A LIQUID

This invention relates to a ski pole adapted to contain a liquid, such as any type of a beverage which may be desired by a skier.

U.S. Pat. No. 3,443,820, discloses a ski pole with liquid container but the device of this invention is subject to a number of drawbacks in that it requires a plastic flask or vial within the ski pole, from which it can be removed, and, further, the hand strap is connected directly to the cap on the ski pole, and exerts an undesirable stress thereon.

U.S. Pat. No. 2,741,485, relates to ski sticks and discloses the mounting of a hand grip and strap assembly to the upper end of the pole, but there is no provision in this patent for containing a liquid in the interior of the ski pole.

U.S. Pat. No. 3,982,747, discloses a ski pole having a handle with a releasable hand strap. The hand strap includes a plate adapted to be inserted in a slot in the handle, which plate is retained in the handle by a pressure adjustable release, which can be a spring-biased ball means engaging in a hole in the plate. There is no suggestion of containing a liquid in the ski pole of this patent.

U.S. Pat. No. 3,561,782, relates to a ski pole construction with liquid reservoir having a hand grip which, when removed, permits partial withdrawal of a flask for drinking use. The present invention is distinguished from this construction in that no flask is employed.

U.S. Pat. No. 3,880,443, relates to a strapless ski pole grip. This construction has no provision for containing a liquid within the ski pole.

The present invention relates to a ski pole which is adapted to contain a liquid, i.e., a beverage, and is constructed with an internal cavity to contain the beverage, which cavity may, if desired, be coated with a lining which will adhere to the inner walls of the pole, thus eliminating the need for a separate, removable plastic vial or container. In the present invention, the hollow pole itself is a liquid container. An attached hand grip is constructed in a manner such as to permit drinking of the beverage contained in the ski pole without removal of the grip from the pole.

Hand grips have heretofore traditionally used hand straps molded into the grip itself, and the present invention provides a hand strap which may be integral with the hand grip and which may be adjusted for different size hands and safety release, when desired.

Figure 6:
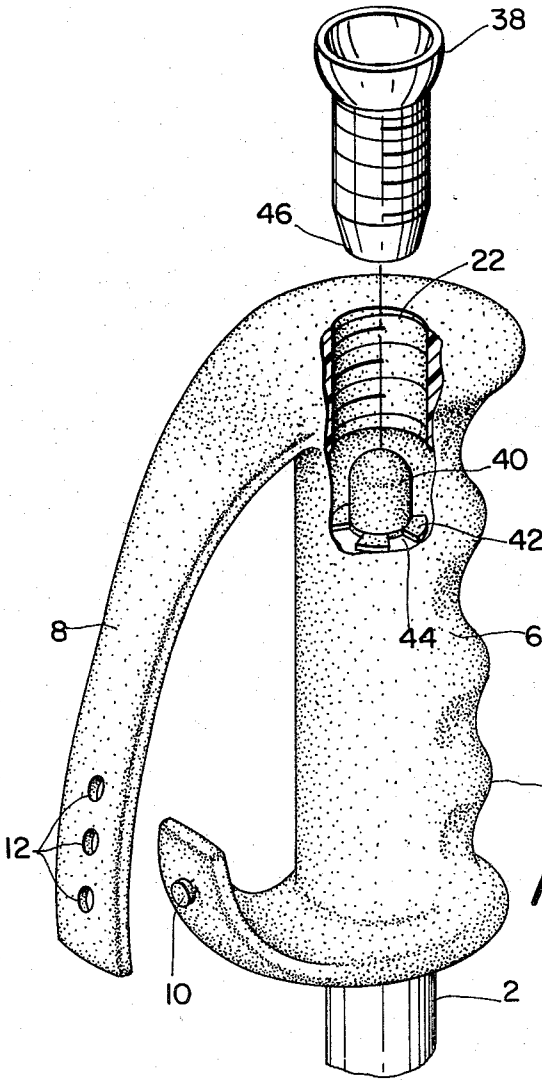
Figure 5:
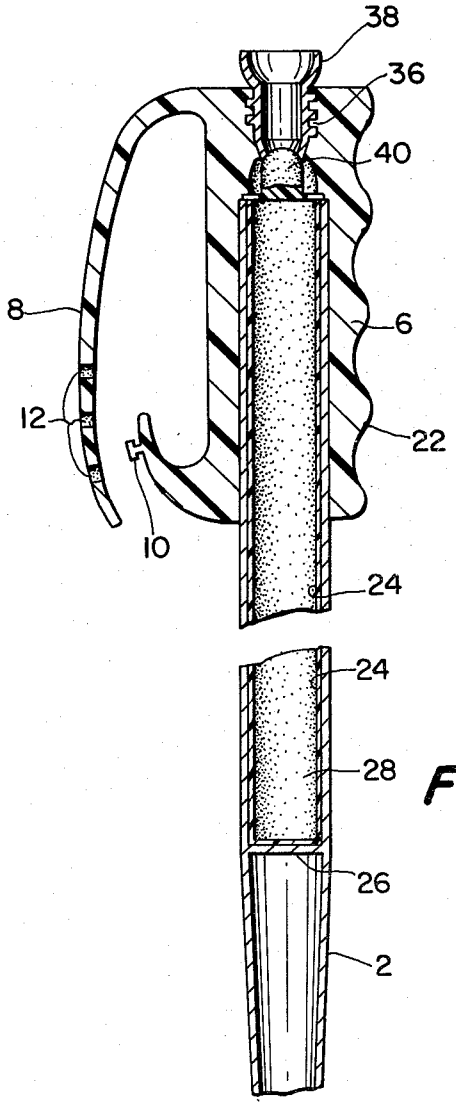

The invention will be further illustrated by reference to the accompanying drawings in which:

FIG. 1 is a view in elevation of one embodiment of the ski pole of the invention, FIG. 2 is a fragmentary enlarged sectional view showing the upper portion of the ski pole of FIG. 1, FIG. 3 is an enlarged perspective view showing the hand grip, hand strap, and cap of the device of FIG. 2, FIG. 4 is a perspective view of a cap adapted for use with the device of FIGS. 1, 2, and 3, and having a retainer ring thereon to prevent loss of the cap when it is removed from the hand grip, FIG. 5 is an enlarged fragmentary sectional view of another embodiment of the upper portion of the ski pole of the invention, and FIG. 6 is an enlarged fragmentary perspective view of the embodiment shown in FIG. 5.

Referring to FIG. 1, one embodiment of the complete ski pole is shown having the shaft 2, which may be made of any suitable material such as a non-toxic aluminum alloy, for example.

Near the bottom of the shaft is the stop basket 4, which is illustrated in a snow-flake design in order to prevent snagging of the basket on trees, brush, and the like. At the upper end of the ski pole is the hand grip 6 having the hand strap 8 integral therewith and being provided with a pin and hole connection 10 and 12, respectively, which is more clearly illustrated in FIGS. 2, 3, and 6.

Referring to FIG. 2, a sectional view of the upper end of the embodiment of FIG. 1 of the invention is shown in which the hand grip 6 is provided with an upwardly extending projection 14 having the external threads 16 thereon and which are adapted to engage with an internally threaded cap 18. A washer 20 of a non-toxic material is seated in the cap 18 in order to provide a seal between the external threaded extension and the internally threaded cap. The hand grip 6 may be molded from any non-toxic plastic material, such as a vinyl plastic, and is secured to the top of the shaft 2 by a press fit. The hand grip is provided with the projections 22 to accommodate the placement of the fingers and prevent slipping of the hand up or down. The interior of the shaft 2 may be provided with an interior coating or liner 24, thereby forming a chamber for liquid together with the bottom 26 which is a member extending across the interior of the shaft and forming an end closure for the thus formed container 28.

Also shown in FIG. 2 is a lip seal 30 which is molded as part of the plastic hand grip 6 and which protrudes downwardly inside the preferably coated aluminum shaft to form a seal between the coated shaft and the vinyl plastic hand grip, whereby leakage from the container 28 adapted to contain the liquid is prevented.

FIG. 3 is a perspective view of the hand strap and cap shown in FIG. 2 and shows the locking assembly for the hand strap in more detail.

The hand strap 8 is designed to be flat and flexible in order to allow pressure release from the vinyl plastic knob 10 located on the lower part of the plastic hand grip 6, when necessary. When the strap is closed by pressing the knob 10 through one of the apertures or holes 12 in the hand strap, a hand support is formed and also aids in holding the hand to the grip. Because the strap 8 is molded with the grip 6 at a point below the threaded extension 14 of the top of the grip, pressure from the hand support thus formed does not cause undue stress on the threaded extension 14 or the cap 18, as does the top mounted strap in previous designs.

FIG. 4 shows a cap 18 of the type used with the embodiment of FIGS. 1, 2, and 3, and having a flexible retainer strap 32 molded as part of the cap 18 which also may be fabricated from a non-toxic vinyl plastic, for example. Also integral with the retainer strap, and designed as part of a retainer device to prevent loss of the cap when it is disengaged from the external projection 14 at the top of the plastic hand grip 6, is the ring 34 which is adapted to be threaded over the projection 14 on the top of the hand grip 6.

Referring to FIG. 5, a second embodiment of the invention is shown in which the hand grip 6 has internal threads 36 molded into the top of the vinyl plastic hand grip 6. A hollow, externally-threaded open plug 38 is threaded into the internally-threaded bore 36 in the top of the hand grip 6 and engages at the lower end thereof with an upwardly projecting member 40 in order to form a sealing closure.

As shown more clearly in FIG. 6, the member 40, which may be fabricated from a non-toxic plastic such as vinyl plastic, is seated on the disc 42 which may be secured to the hand grip in any suitable manner, and having the cut-away portions 44 in order to permit liquid to flow through the cut-away portions when the hollow open plug 38 is partially unscrewed. As shown in FIG. 6, the hollow open plug 38 has a tapered bottom portion 46 adapted to engage with the upwardly extending member 40 to form a liquid-tight closure when the hollow open plug is screwed completely into the internally-threaded hand grip 6.

Using the device of FIGS. 5 and 6 it is possible for one to drink the liquid in the container 28 without completely removing the hollow open plug 38. All that is required is to partially unscrew the plug 38 and the liquid then can flow from the container 28 through the cut-away portions 44 and the hollow open interior of the plug 38. In this manner, it is possible to drink from the ski pole without completely removing the hollow open plug 38 and thereby minimize the possibility of loss of the plug 38.

It will be obvious to those skilled in the art that many modifications may be made within the scope of the present invention without departing from the spirit thereof, and the invention includes all such modifications.

What is claimed is:

1. In a ski pole comprising a shaft, a hand grip, a stop basket, and a cavity in said shaft, the improvement comprising non-toxic liner means directly on the interior wall of said shaft in said cavity, whereby said cavity is adapted to contain a liquid, hand strap means on said hand grip, and access means, in said hand grip, to said cavity, said access means being an internally threaded bore in said hand grip, and a hollow, open-ended plug means adapted to be received in said bore and to engage a sealing means in said hand grip.

* * * * *